United States Patent [19]

Bozek et al.

[11] 3,952,911

[45] Apr. 27, 1976

[54] NON-DETACHABLE AND RECLOSABLE EASY OPENING CONTAINER CLOSURE STRUCTURE

[75] Inventors: John S. Bozek, Chicago; Harry A. Peyser, Olympia Fields, both of Ill.

[73] Assignee: Continental Can Company, Inc., New York, N.Y.

[22] Filed: June 8, 1973

[21] Appl. No.: 368,163

[52] U.S. Cl. ..... 220/269; 220/90.6; 220/331; 220/307; 220/359

[51] Int. Cl.[2] ..... B65D 41/46

[58] Field of Search ..... 220/24 R, 24 A, 24 B, 220/80, 32, 33, 34, 38, 60, 55, 27, 36, 52, 53, 54, 59, 90.6, 269, 331, 359, 307; 229/7 R

[56] References Cited

UNITED STATES PATENTS

| | | | |
|---|---|---|---|
| 3,021,976 | 2/1962 | Tracy | 220/60 R |
| 3,080,088 | 3/1963 | Corrinet | 220/60 R |
| 3,259,265 | 7/1966 | Stuart | 220/38 |
| 3,372,832 | 3/1968 | Yeater | 220/60 R |
| 3,437,227 | 4/1969 | Peyser | 220/269 |
| 3,438,542 | 4/1969 | Feld | 220/60 R |
| 3,472,416 | 10/1969 | Hilton | 220/60 R |
| 3,473,692 | 10/1969 | Moller | 220/90.6 |
| 3,526,351 | 9/1970 | Goldstein | 229/7 R |
| 3,627,168 | 12/1971 | Fraze | 220/54 |
| 3,708,091 | 1/1973 | Douty | 220/41 |
| 3,731,835 | 5/1973 | Hawkins | 220/47 |
| 3,731,836 | 5/1973 | Silver | 220/54 |
| 3,734,338 | 5/1973 | Schubert | 220/54 |
| 3,813,000 | 5/1974 | Underwood | 222/541 |

FOREIGN PATENTS OR APPLICATIONS

| | | | |
|---|---|---|---|
| 482,838 | 8/1938 | United Kingdom | D9/256 |

*Primary Examiner*—William Price
*Assistant Examiner*—Ro E. Hart
*Attorney, Agent, or Firm*—Diller, Brown, Ramik & Wight

[57] ABSTRACT

An easy opening closure for a container in which the end panel is formed with a pre-cut opening. A plastic tab having a closure portion is pivotally secured to the panel for turning between a position overlying said opening to seal the same and a position away from the opening. The tab includes a finger grip portion encompassing the closure portion.

9 Claims, 5 Drawing Figures

FIG. 1
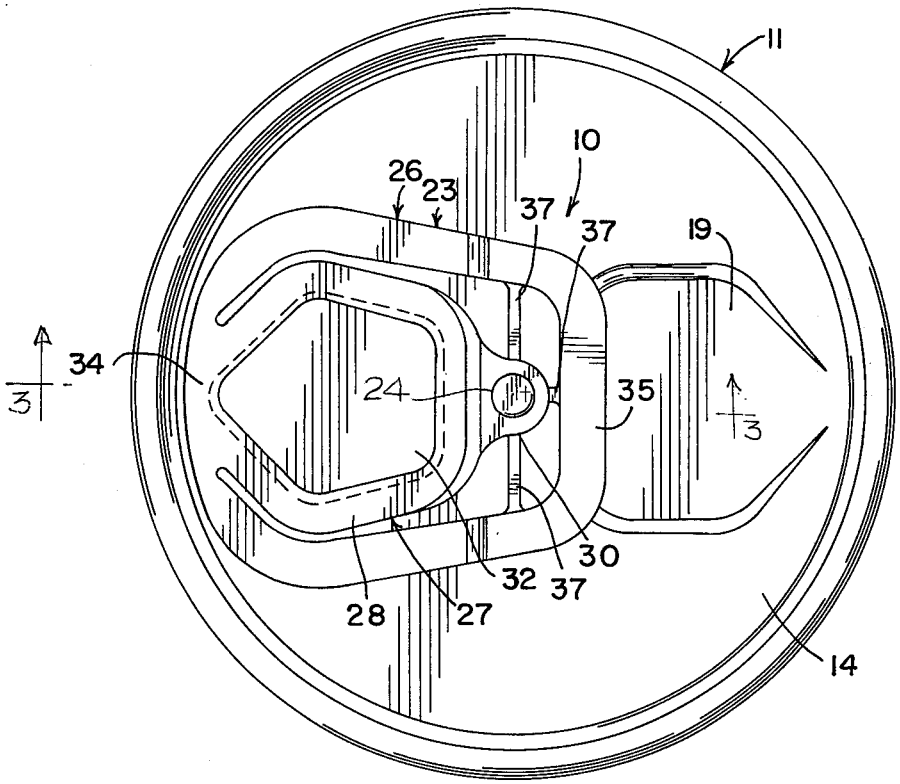
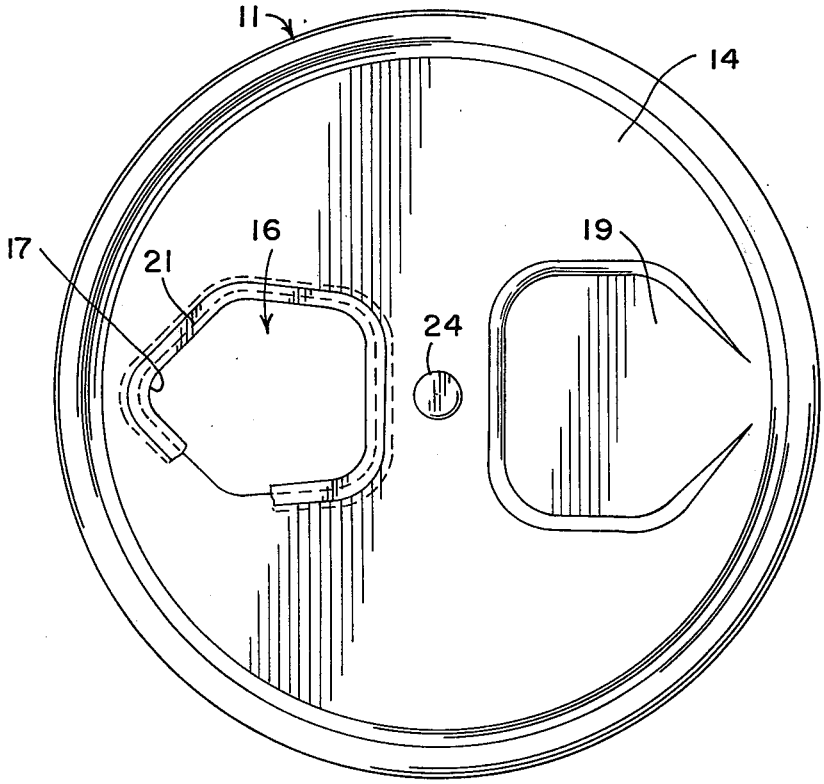
FIG. 2

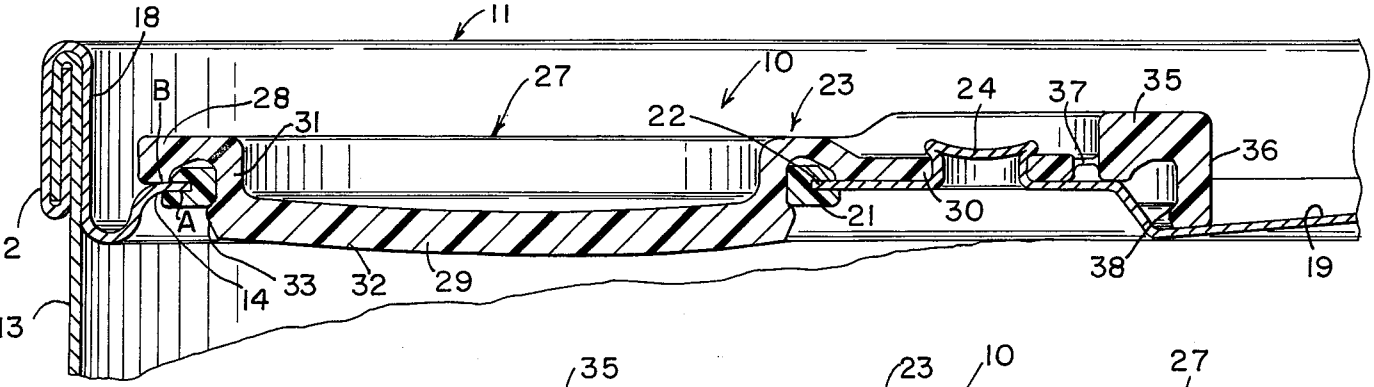
FIG. 3
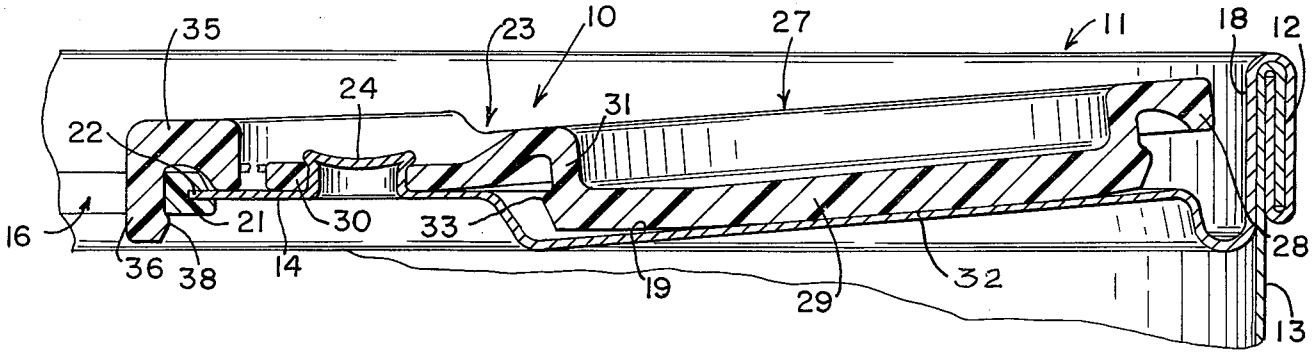
FIG. 4
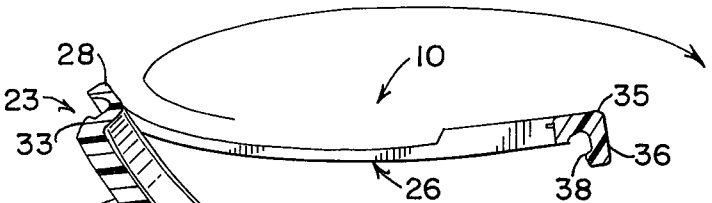
FIG. 5
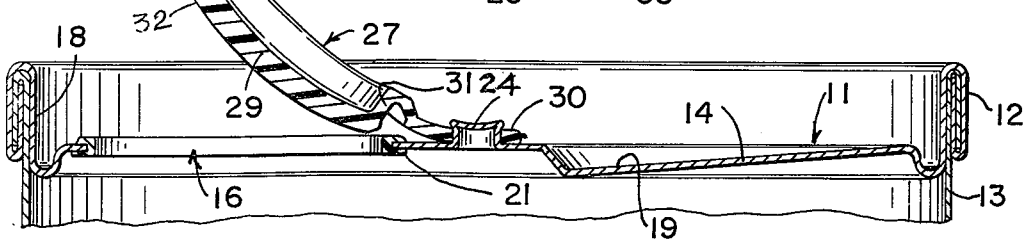

NON-DETACHABLE AND RECLOSABLE EASY OPENING CONTAINER CLOSURE STRUCTURE

BACKGROUND AND SUMMARY OF THE INVENTION

The present invention relates to easy opening containers and more particularly to easy opening containers having a pre-cut opening sealed with a plastic closure tab.

Containers of the general type to which the present invention relates comprise generally a container having a metal end closure in which the plastic closure is releasably bonded to the metal can in overlying relationship to the pour opening. This structure is illustrated in U.S. Pat. No. 3,731,835 issued May 8, 1973 assigned to the assignee of the present invention which is incorporated herein by reference thereto. The easy opening structure in the aforesaid application provides a closure tab which is completely separated from the container so that they are separately discarded. Careless discarding of either the container or closure creates a litter problem. Moreover, it is frequently desired to reclose the opening after initial opening. The prior structures have either not been satisfactory to permit reclosure or when the closure portion was separated it was misplaced.

By the present invention it is proposed to provide an easy opening closure for containers which overcomes the difficulties encountered heretofore.

This is accomplished generally by the provision of an end closure having a tab made separately from the end and which is permanently attached thereto by a post about which it pivots between a closed and open position over a pre-cut pour opening. The tab further includes a marginal portion which bounds the opening and is releasably bound thereabout to form a seal capable of resisting pressure forces exerted by the product in the containers and which is releasable upon the application of a manual pulling force.

BRIEF DESCRIPTION OF THE DRAWINGS

FIG. 1 is an enlarged top plan view of an end of a container incorporating the easy opening structure of the present invention.

FIG. 2 is an enlarged top plan view similar to FIG. 1 but with the closure tab removed.

FIG. 3 is a fragmentary cross-sectional view taken generally along the lines 3—3 of FIG. 1 showing the closure tab in the closed position.

FIG. 4 is a cross-sectional view similar to FIG. 3 but showing the closure tab in the open position.

FIG. 5 is a cross-sectional view similar to FIGS. 3 and 4 but showing the closure tab in a position intermediate the closed and opened positions.

DESCRIPTION OF THE PREFERRED EMBODIMENT

Referring now to the drawings, the easy opening structure 10 embodying the principles of the present invention is incorporated in an end closure 11 which is attached as by means of a double seam 12 to a container body 13. The end closure 11 includes a panel 14 having a pour opening 16 through which the contents of the container may be poured.

The pour opening 16 may be in the form of a pentagon with two sides forming a nose 17 located adjacent the chuck wall 18 of the end closure 11. A generally pentagonal recess 19 is also formed in the panel 14 in diametrically opposed relationship to the pour opening 16.

A rim 21 having a groove 22 is seated about the marginal edges defining the opening 16. The rim 21 which is made from a plastic material such as polyethylene or polypropylene may be permanently bonded to the panel by means of bond coating applied about the opening. Suitable bonding coatings are disclosed in U.S. Pat. No. 3,616,047 issued Oct. 26, 1971 assigned to the assignee of the present invention and incorporated herein by reference.

A tab 23 which is also made from a plastic material such as polyethylene, polypropylene or the like is fastened to the end panel 14 by means of a rivet 24 which may be integral with the panel. The rivet 24 provides a post about which the tab 23 is turnable as will be more fully explained hereinafter.

The tab 23 includes a grip portion 26 and a closure portion 27. The closure portion 27 is shaped similarly to the pour opening 16 and has a marginal band 28 which is releasably adhered to the end closure outwardly of the rim 21. A suitable releasable bonding coating of the type disclosed in the aforementioned U.S. Pat. No. 3,616,047 may be used to attach the band 28 to the end. The closure panel 29 having a depending side wall 31 and a bottom wall 32 is seated within the opening 16. The side wall 31 may be provided with a projecting ridge or rib 33 which serves to resiliently latch the closure portion 27 in the opening 16. The marginal band 28 includes an attachment web 30 which turnably receives the rivet 24.

The grip portion 26 is integrally attached to the closure portion 27 at a closure nose 34 and is in the form of a pentagonal loop and shaped generally the same as closure panel 27. The loop opposite the nose 34 may be a somewhat thicker section 35 than the remainder and includes a downwardly projecting leg 36 having a latching ridge or rib 38 along the lower inner portion thereof. The thicker section 35 including the support leg 36 defines a finger grip. The finger grip 35 encompasses the attachment web 30 and is connected thereto by angularly spaced thin webs 37. The webs 37 are sufficiently thin so as to break upon lifting of the finger grip portion 26. The thin-webs 37 thus serve as tamper proof indicators which when broken indicate the effort to tamper with the closure.

To open the container, the finger grip 26 is grasped and lifted upwardly so that the webs 37 are broken. The finger grip 26 is lifted to the position shown in FIG. 5 causing the bond to the panel 14 on the marginal band 28 to be released so that the closure panel 29 may be lifted out of the opening 16. Thereafter, the finger grip 26 and the closure portion 27 attached thereto are rotated about the rivet 24.

When the tab 23 is rotated into the position shown in FIG. 5, the finger grip portion 26 is released so that the latter and the closure are accommodated within the recess 19. It is to be noted as shown in FIG. 4 that in this position the ridge 38 is resiliently disposed beneath the rim 21 so as to be latched in position. An unobstructed pour opening 16 is thus assured because the tab is prevented from turning about the rivet 24.

Should it be desired to reclose the opening 16, the finger grip 35 is lifted to disengage the ridge 38 from the rim 21 so that the tab may be rotated until the closure panel 29 is again aligned with the opening 16. Thereafter, the panel 29 is pushed downwardly so that the ridge 33 yieldable snaps beneath the rim 21 to reseal the opening 16.

What is claimed is:

1. An easy opening end closure for a container, said end closure comprising a panel, an opening in said panel, a tab having an integral closure portion for said opening, means releasably bonding said closure portion to said panel surrounding said opening, pivot means pivotally connecting said closure portion to said panel for pivoting about an axis disposed substantially normal to said panel so that said closure portion may be turned between a position closing said opening and a position spaced from said opening when said closure portion is released from said panel, said tab including a finger grip portion in the form of a closed loop encompassing said closure portion, said loop being connected to said closure portion at a point located opposite the connection to said pivot means.

2. An easy opening end closure for a container, said end closure comprising a panel, an opening in said panel, a tab having an integral closure portion for said opening, means releasably bonding said closure portion to said panel surrounding said opening, pivot means pivotally connecting said closure portion to said panel for pivoting about an axis disposed substantially normal to said panel so that said closure portion may be turned between a position closing said opening and a position spaced from said opening when said closure portion is released from said panel, said panel having an edge defining said opening, a rim seated on said edge, and the bonding of said closure portion to said panel including an attachment band on said closure portion releasably bonded to said panel outwardly of said rim.

3. The invention as defined in claim 2 wherein said tab includes a finger grip portion in the form of a closed loop, said loop being attached to said closure portion at a point opposite said connection to said pivot means.

4. The invention as defined in claim 3 wherein said closure portion includes a rib resiliently seatable beneath said rim to releasably latch said closure portion in said opening after said attachment band is separated from said panel.

5. An easy opening end closure for a container, said end closure comprising a panel, an opening in said panel, a tab having a closure portion for said opening, means releasably bonding said closure portion to said panel, pivot means pivotally connecting said closure portion to said panel so that said closure portion may be turned between the position closing said opening and a position spaced from said opening when said closure portion is released from said panel, said panel having an edge defining said opening, a rim seated on said edge, the bonding of said closure portion to said panel including an attachment band on said closure portion releasably bonded to said panel outwardly of said rim, said tab including a finger grip portion in the form of a closed loop, said loop being attached to said closure at a point opposite said connection to said pivot means, and said closed loop including a projecting leg having a rib, said rib being resiliently seatable beneath said rim when said tab is in said open position.

6. The invention as defined in claim 5 wherein said closure portion includes a rib resiliently seatable beneath said rim to releasably latch said closure portion in said opening when said tab is in said closed position.

7. An easy opening end closure for a container, said end closure comprising a panel, an opening in said panel, a tab having an integral closure portion for said opening, means releasably bonding said closure portion to said panel surrounding said opening, pivot means pivotally connecting said closure portion to said panel for pivoting about an axis disposed substantially normal to said panel so that said closure portion may be turned between a position closing said opening and a position spaced from said opening when said closure portion is released from said panel, said tab including a projecting leg having a rib, and said rib being positioned relative to said opening and said pivot means to be resiliently seatable within said opening and locked relative to said panel when said tab is in said open position.

8. The invention as defined in claim 7 wherein said panel has an edge defining said opening, a rim is seated on said edge, and said rib being resiliently seatable beneath said rim when said tab is in said open position.

9. The invention as defined in claim 7 wherein said tab includes a finger grip portion in the form of a closed loop, said loop being attached to said closure portion at a point opposite said connection of said closure portion to said pivot means, and said projecting leg being carried by said loop.

* * * * *